US010060428B2

(12) United States Patent
Galeotti

(10) Patent No.: US 10,060,428 B2
(45) Date of Patent: Aug. 28, 2018

(54) METHOD FOR OPERATING A COMPRESSOR IN CASE OF FAILURE OF ONE OR MORE MEASURED SIGNALS

(71) Applicant: Nuovo Pignone Srl, Florence (IT)

(72) Inventor: Daniele Galeotti, Florence (IT)

(73) Assignee: Nuovo Pignone Srl, Florence (IT)

( * ) Notice: Subject to any disclaimer, the term of this patent is extended or adjusted under 35 U.S.C. 154(b) by 328 days.

(21) Appl. No.: 14/441,013

(22) PCT Filed: Nov. 5, 2013

(86) PCT No.: PCT/EP2013/073047
§ 371 (c)(1),
(2) Date: May 6, 2015

(87) PCT Pub. No.: WO2014/072286
PCT Pub. Date: May 15, 2014

(65) Prior Publication Data

US 2015/0300347 A1 Oct. 22, 2015

(30) Foreign Application Priority Data

Nov. 7, 2012 (IT) ..... CO2012A0056

(51) Int. Cl.
*F04B 49/10* (2006.01)
*F04D 27/02* (2006.01)

(52) U.S. Cl.
CPC ..... *F04B 49/10* (2013.01); *F04D 27/02* (2013.01); *F04D 27/0292* (2013.01)

(58) Field of Classification Search
CPC ..... F04B 49/10; F04B 49/065; F04D 27/02
See application file for complete search history.

(56) References Cited

U.S. PATENT DOCUMENTS 4,594,051 A * 6/1986 Gaston ..... F04D 27/001 374/10
4,656,589 A * 4/1987 Albers ..... F04D 27/0207 415/1

(Continued)

FOREIGN PATENT DOCUMENTS

CN 1836109 A 9/2006
CN 101876323 A 11/2010

(Continued)

OTHER PUBLICATIONS

Italian Search Report and Written Opinion dated Jul. 5, 2013 which was issued in connection with Italian Patent Application No. CO2012A000056 which was filed on Nov. 7, 2012.

(Continued)

*Primary Examiner* — Dominick L Plakkoottam
*Assistant Examiner* — Benjamin Doyle
(74) *Attorney, Agent, or Firm* — GE Global Patent Operation

(57) ABSTRACT

A method for operating a compressor. The method includes: acquiring a plurality of measured data; verifying the congruence of the measured data through the calculation of the molecular weight of the compressed gas based on compressor adimensional analysis; in case of failure of a first measurement of the measured data, substituting the first measurement with an estimated value based on the last available value of the molecular weight and on the available measurements of the measured data and on compressor adimensional analysis; and determining an estimated operative point on an antisurge map based on the estimated value and on the available measurements of the measured data.

10 Claims, 7 Drawing Sheets

(56) References Cited

U.S. PATENT DOCUMENTS 4,697,980 A * 10/1987 Keyes, IV ..... F04D 27/0207 415/1
4,825,380 A * 4/1989 Hobbs ..... F04D 27/0207 415/11
4,861,233 A * 8/1989 Dziubakowski .... F04D 27/0207 415/27
4,872,120 A * 10/1989 Orloff ..... B64C 17/10 244/135 C
4,900,232 A * 2/1990 Dziubakowski .... F04D 27/0207 417/201
4,949,276 A * 8/1990 Staroselsky ..... F04D 27/0284 415/1
4,971,516 A * 11/1990 Lawless ..... F04D 27/0207 415/1
5,195,875 A * 3/1993 Gaston ..... F04D 27/0207 415/27
5,355,691 A * 10/1994 Sullivan ..... F04D 27/0261 415/17
5,386,373 A * 1/1995 Keeler ..... F02D 41/1401 700/266
5,508,943 A * 4/1996 Batson ..... F04D 27/0207 415/1
5,553,997 A * 9/1996 Goshaw ..... F04D 27/0261 415/17
5,709,526 A * 1/1998 McLeister ..... F04D 27/0207 415/1
5,798,941 A * 8/1998 McLeister ..... G05B 11/42 415/1
5,831,851 A * 11/1998 Eastburn ..... G05B 19/4184 700/114
6,217,288 B1 * 4/2001 Mirsky ..... G05B 5/01 417/282
6,503,048 B1 1/2003 Mirsky
6,625,573 B2 * 9/2003 Petrosov ..... G01N 9/32 702/24
7,069,733 B2 * 7/2006 Lucas ..... F04D 27/0207 62/115
7,094,019 B1 * 8/2006 Shapiro ..... F04D 27/0284 415/17
7,096,669 B2 * 8/2006 Narayanan ..... F04D 27/0207 415/1
7,522,963 B2 * 4/2009 Boyden ..... B01D 53/346 422/111
8,567,184 B2 * 10/2013 Scotti Del Greco ... F02C 1/005 417/323
8,650,009 B2 * 2/2014 Forbes ..... G05B 17/02 703/2
9,074,606 B1 * 7/2015 Moore ..... F04D 17/12
9,127,684 B2 * 9/2015 Galeotti ..... F04D 27/0207
9,133,850 B2 * 9/2015 Narayanan ..... F04D 27/0223
9,416,790 B2 * 8/2016 Brenne ..... F04D 27/0207
2002/0062679 A1 * 5/2002 Petrosov ..... G01N 9/32 73/23.2
2004/0151576 A1 * 8/2004 Blotenberg ..... F04D 27/02 415/1
2005/0265822 A1 12/2005 Fledersbacher et al.
2006/0047366 A1 * 3/2006 Boyden ..... G05B 13/048 700/266
2007/0110587 A1 5/2007 Takeshita
2009/0112368 A1 * 4/2009 Mann, III ..... B64F 1/364 700/275
2009/0274565 A1 * 11/2009 White ..... F04D 27/0215 417/282
2009/0317260 A1 12/2009 Mirsky et al.
2010/0272588 A1 10/2010 Scotti Del Greco et al.
2011/0229303 A1 9/2011 Winkes
2012/0048387 A1 3/2012 Galeotti
2012/0207622 A1 * 8/2012 Ebisawa ..... F04D 27/0223 417/53
2013/0129477 A1 * 5/2013 Winkes ..... F04D 27/0207 415/1
2014/0154051 A1 * 6/2014 Di Febo ..... F04D 27/02 415/17
2015/0300347 A1 * 10/2015 Galeotti ..... F04B 49/10 417/53

FOREIGN PATENT DOCUMENTS

CN 102224346 A 10/2011
CN 102392812 A 3/2012
CN 102400903 A 4/2012
EP 1555438 A2 7/2005
JP 2000337109 A 12/2000
WO 2004038229 A1 5/2004
WO 2012007553 A1 1/2012

OTHER PUBLICATIONS

International Search Report and Written Opinion dated Dec. 9, 2013 which was issued in connection with PCT Patent Application No. PCT/EP13/073047 which was filed on Nov. 5, 2013.
Unofficial English translation of Chinese Office Action issued in connection with corresponding CN Application No. 201380058396.9 dated Apr. 25, 2016.
Daniele Galeotti et al., filed Sep. 25, 2015, U.S. Appl. No. 14/780,170.
Unofficial English Translation of Italian Search Report & Written Opinion issued in connection with Related IT Application No. FI2013A000063 dated Nov. 21, 2013.
PCT Search Report & Written Opinion issued in connection with Related PCT Application No. PCT/EP2014/055830 dated May 13, 2014.
Unofficial English Translation of Chinese Office Action issued in connection with Related CN Application No. 201480018356.6 dated May 5, 2016.

* cited by examiner

METHOD FOR OPERATING A COMPRESSOR IN CASE OF FAILURE OF ONE OR MORE MEASURED SIGNALS

BACKGROUND

Embodiments of the present invention relate to methods for operating a compressor in case of failure of one or more measure signal, in order not to cause the antisurge controller to intervene by opening the antisurge valve, but, instead, to continue to operate the compressor, at the same time providing an adequate level of protection through a plurality of fallback strategies.

Anti-surge controller requires a plurality of field measures, acquired by the controller through a plurality of sensors and transmitters, to identify the compressor operative point position in the invariant compressor map. In case of failure, for example loss of communication between transmitter and controller, of a required measurement, operative point position is not evaluated. When this occurs, a worst case approach is commonly used to operate the compressor safely. With this approach, the failed measure is replaced by a value which permits to shift the operative point towards the surge line as safely as possible. For example, in compressor installations including a flow element at suction: in case of loss of the value of discharge pressure, the latter is substituted with the maximum possible value thereof, and in case of loss of the value of differential pressure in the flow element (h), the minimum possible value (i.e.: zero value) of such differential pressure is chosen.

In any case, this worst case approach tends to open the anti-surge valve, usually losing process availability even when this is not required by actual operating conditions.

It would be therefore desirable to provide an improved method which permits to safely operate a compressor and, at the same time, to avoid the above inconveniencies of the known prior arts.

SUMMARY

According to a first embodiment, a method for operating a compressor is provided. The method comprising: acquiring a plurality of measured data obtained from a plurality of respective measurements at respective suction or discharge sections of the compressor; verifying the congruence of the measured data through the calculation of the molecular weight of a gas compressed by the compressor; in case of failure of a first measurement of said measured data, substituting said first measurement with an estimated value based on the last available value of said molecular weight and on the available measurements of said measured data; determining an estimated operative point on an antisurge map based on said estimated value and on the available measurements of said measured data.

According to another aspect of the present invention, substituting said first measurement with an estimated value is performed during a predetermined safety time interval.

According to a further aspect of the present invention, the method comprises, in case of failure of a second measurement of said measured data or at the end of the safety time interval: substituting said first and second measurements with respective worst case values based on maximum and/or minimum values of said first and second measurements; and determining a worst-case point on the antisurge map based on said worst case values and on the available measurements of said measured data.

According to another embodiment, a computer program directly loadable in the memory of a digital computer is provided. program comprising portions of software code suitable for executing: acquiring a plurality of measured data obtained from a plurality of respective measurements at respective suction or discharge sections of the compressor; verifying the congruence of the measured data through the calculation of the molecular weight of a gas compressed by the compressor; in case of failure of a first measurement of said measured data, substituting said first measurement with an estimated value based on the last available value of said molecular weight and on the available measurements of said measured data; determining an estimated operative point on an antisurge map based on said estimated value and on the available measurements of said measured data, when said program is executed on one or more digital computers.

With such method, considering the compressor behaviour model given by adimensional analysis, one failed measure is calculated by using the remaining plurality of healthy measured data. The substitution, on the map, of the measured operative point with an estimated operative point prevents discontinuity on the point positioning, thus avoiding unneeded intervention of the anti-surge control and process upset.

BRIEF DESCRIPTION OF THE DRAWINGS

Other object features and advantages of the present invention will become evident from the following description of the embodiments of the invention taken in conjunction with the following drawings, wherein.

DETAILED DESCRIPTION OF SOME PREFERRED EMBODIMENTS OF THE INVENTION

Figure 1:
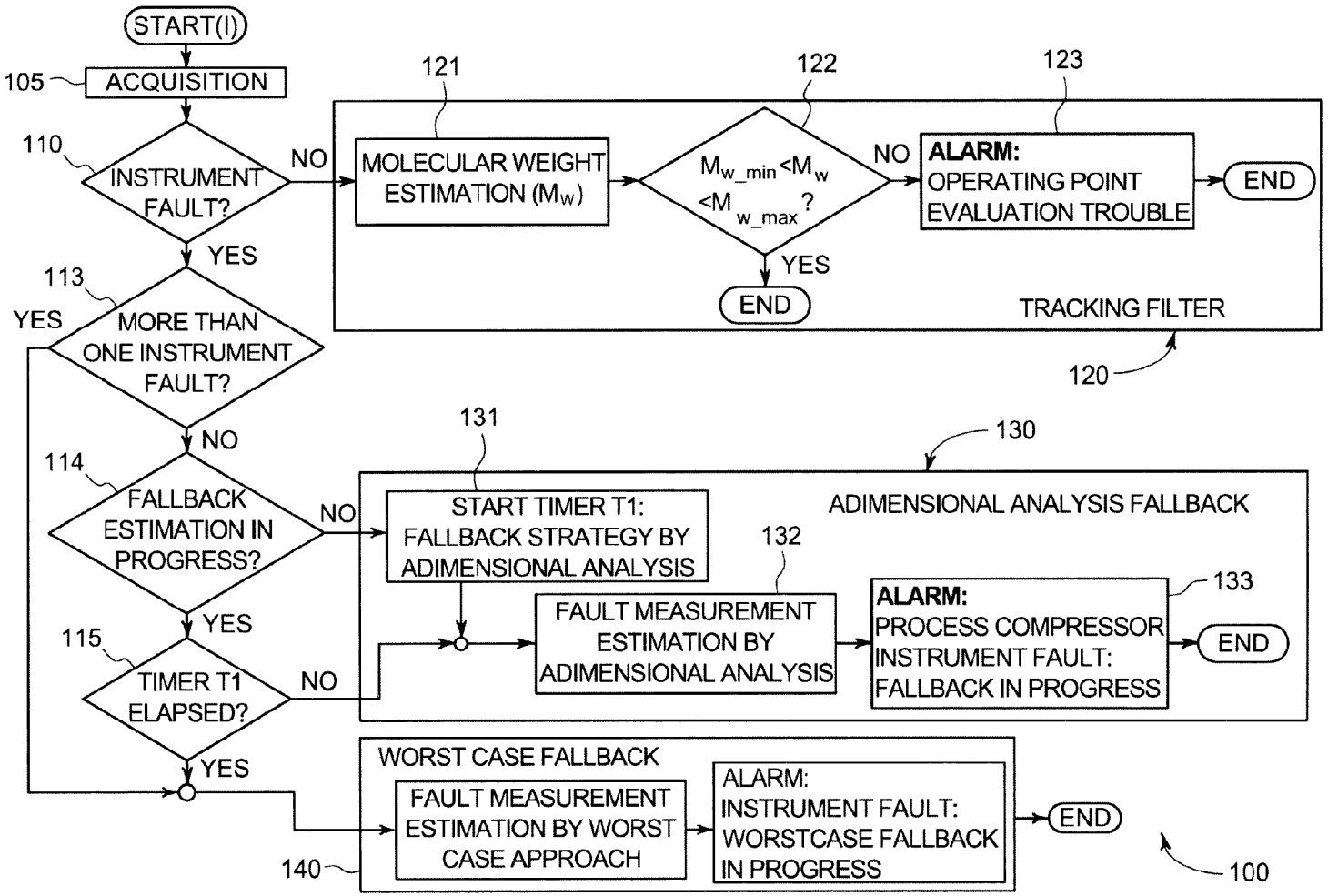
FIG. 1 is a general block diagram of a method for operating a compressor, according to an embodiment of the present invention.
Figure 3B:
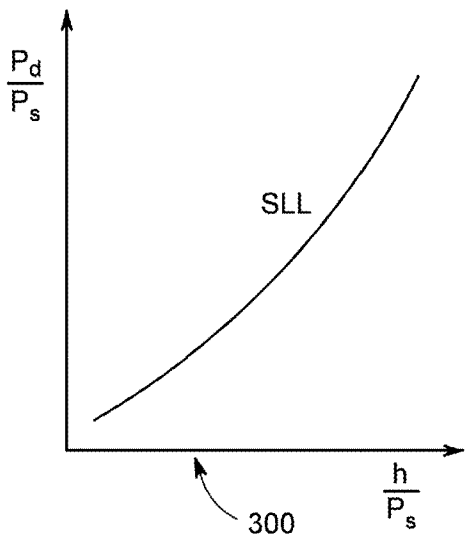
FIG. 3B is a diagram of an antisurge map of the compressor in FIG. 3A.
Figure 3A:
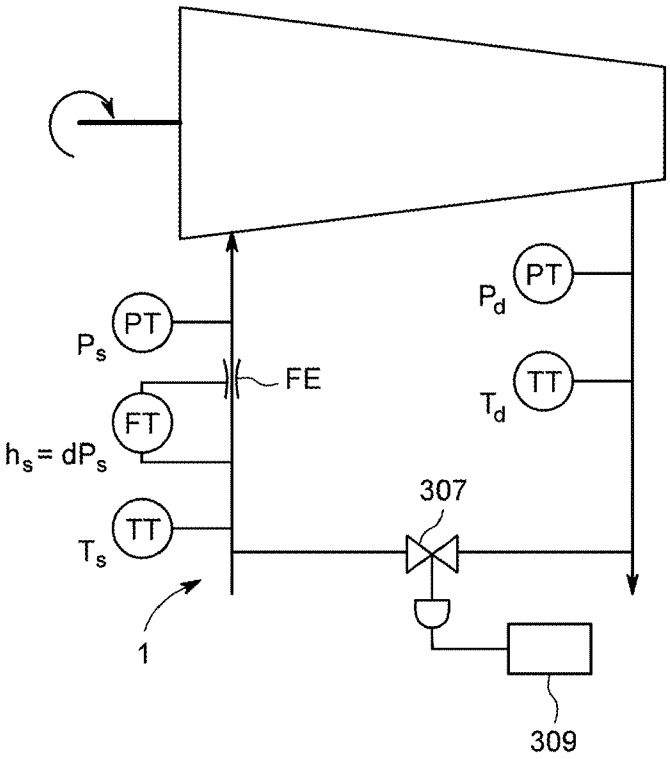
FIG. 3A is a first schematic example of a compressor which can be operated by the an embodiment of the method of the present invention.
Figure 7B:
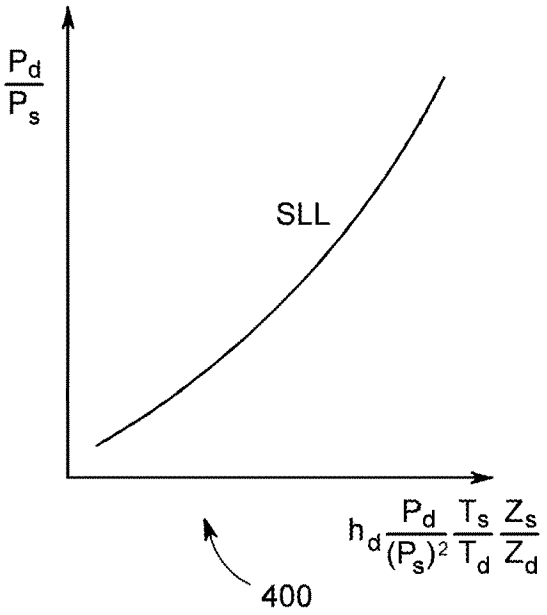
FIG. 7B is a diagram of an antisurge map of the compressor in FIG. 7A.
Figure 7A:
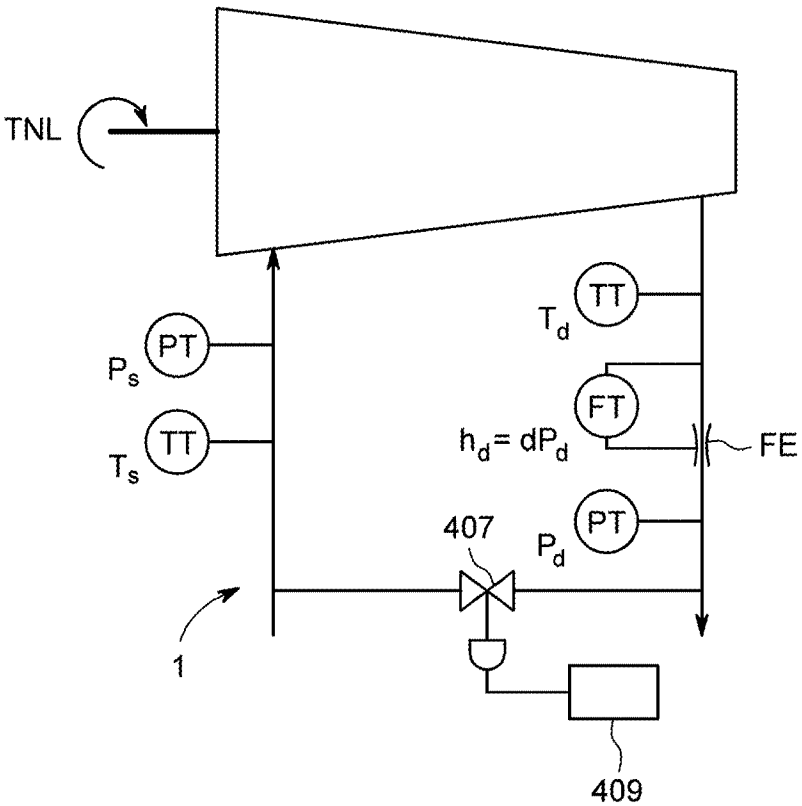
FIG. 7A is a second schematic example of a compressor which can be operated by an embodiment of the method of the present invention.
Figure 8:
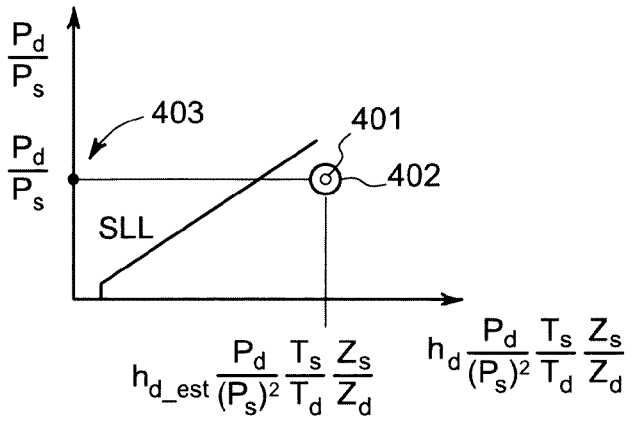
FIGS. 8, 9, 10, 11, and 12 are five diagrams of the antisurge map in FIG. 7B, corresponding respectively to five different failure conditions which can be managed through the method in FIG. 1, for the compressor in FIG. 7A.
Figure 9:
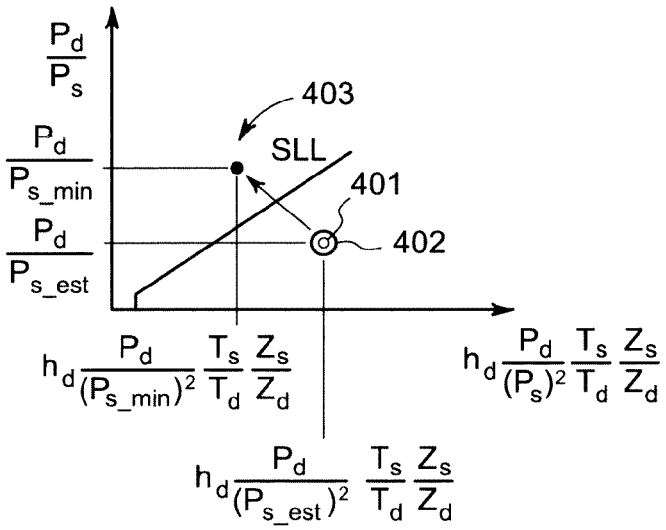
Figure 10:
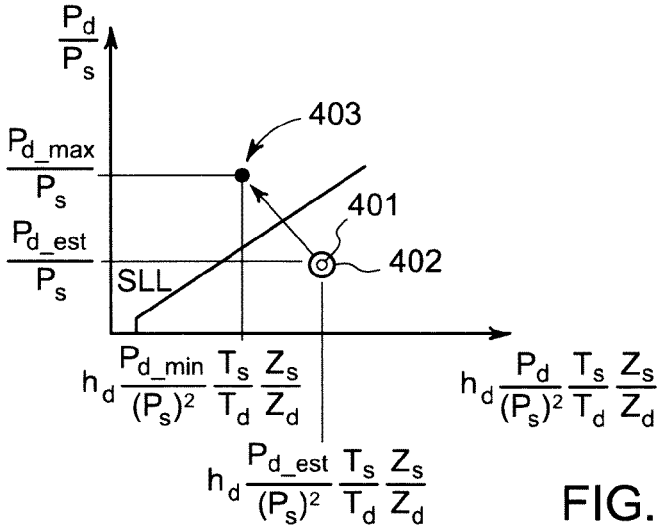
Figure 11:
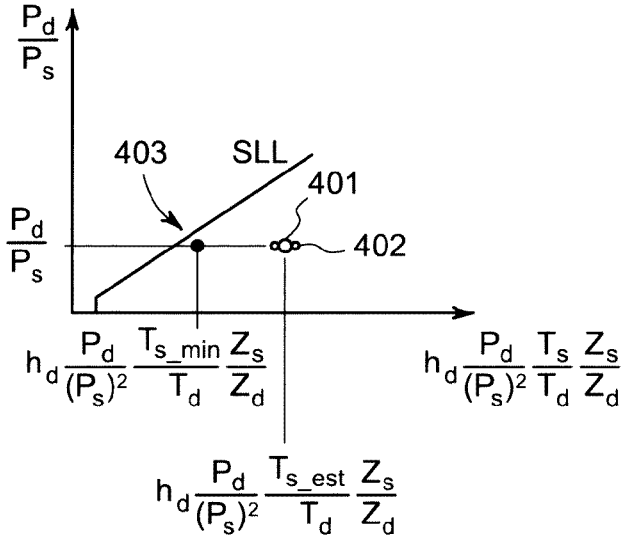
Figure 12:
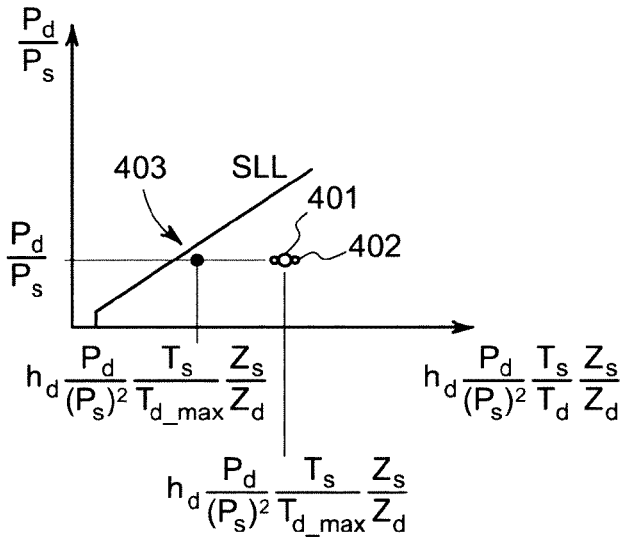

With reference to the diagram in FIG. 1 and to the schematic examples in FIGS. 3A and 7A, a method for operating a centrifugal compressor 1, according to an embodiment of the present invention, is overall indicated with 100. Method 100 operates compressor 1 by validating measures which are used in determining the operative point on an antisurge map. Fallback strategies are provided in case one or more than one measures are missing. At the end of method 100 a plurality of values, either measured or calculated, are made available for calculating the operative point on an antisurge map.

The method is repetitively executed by the control unit 309, 409, for example a PLC system, associated with the compressor 1. The time interval between two consecutive executions of method 100 may correspond to the scan time of control (PLC) unit.

The method 100 comprises a preliminary step 105 of acquiring a plurality of measured data from a respective plurality of instruments which are connected at the suction and discharge of a centrifugal compressor 1. Measured data includes:

suction pressure $P_s$,
discharge pressure $P_d$,
suction temperature $T_s$,
discharge temperature $T_d$, and
differential pressure $h_s=dP_s$ or $h_d=dP_d$ on a flow element FE at suction or discharge, respectively.

The above data are those normally used to determine the operative point of the compressor 1 on an antisurge map.

The antisurge map used for method 100 is an adimensional antisurge map. Various types of antisurge maps can be used. If the flow element FE is positioned at the suction side of the compressor 1 a $h_s/P_s$ (abscissa) vs $P_d/P_s$ (ordinate) map 300 is used (FIGS. 3*b*, 4-6). When the adimensional map 300 is used, the three measures of $h_s$, $P_s$ and $P_d$ are required to identify the operating point position on the map. Complete adimensional analysis, as explained in more detail in the following, also requires the measurements of suction and discharge gas temperature $T_s$, $T_d$. If the flow element FE is positioned at the discharge side of the compressor 1 a $h_s/P_s$ vs $P_d/P_s$ map 400 is used (FIGS. 7B, 8-10). However, in the latter case, $h_s=dP_s$ is not available and has to be calculated with the following known-in-the-art formula:

$$h_s=h_d\cdot(P_d/P_s)\cdot(T_s/T_d)\cdot(Z_s/Z_d) \quad \text{(A)}$$

Application of formula A to identify the operating point position on the map 400 requires a set of five measures of $h_d$, $P_s$, $P_d$ $T_s$, $T_d$.

Alternatively, in both cases, i.e. when the flow element FE is positioned either at suction or discharge, reduced head $h_r$ can be mapped, instead of the compression ratio $P_d/P_s$, on the ordinate axis together with $h_s/P_s$ on the abscissa axis. When the latter map is used, the five measures of $h_s$, $P_s$, $P_d$ $T_s$, $T_d$ are required to identify the operating point position on the map, through the calculation of $h_r$.

After the preliminary step 105, method 100 comprises a first operative step 110 of detecting an instrument fault among the plurality of instruments which are connected at the suction and discharge of the compressor 1.

Figure 2:
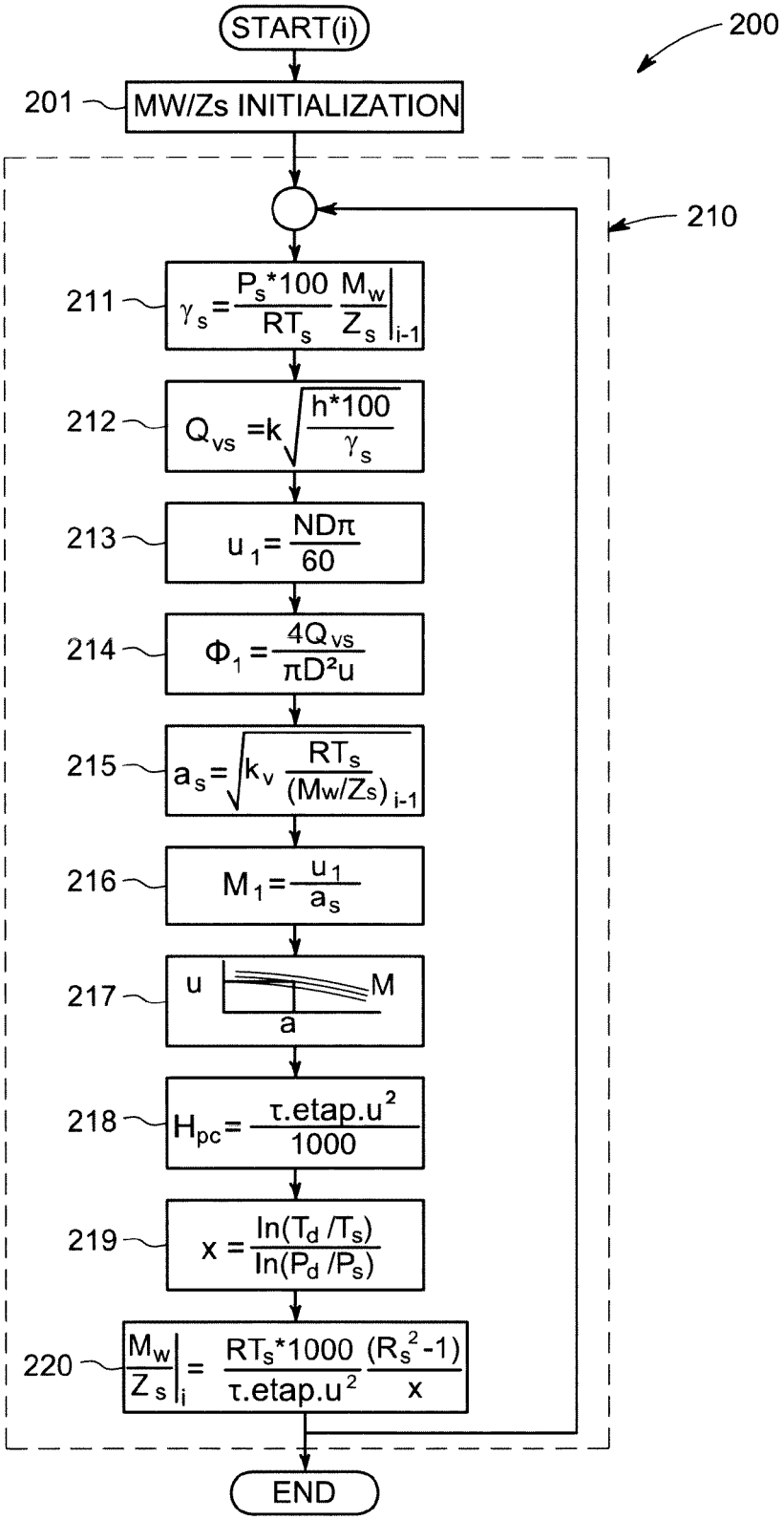
FIG. 2 is a partial block diagram of the method in FIG. 1 according to an embodiment of the present invention.

If no instrument fault is detected during the first step 110, the method 100 proceeds with a second operative step 120 of verifying the congruence of the plurality of measured data. The second step 120 comprises a first sub-step 121 of calculating the molecular weight $M_w$ of the gas compressed by the compressor 1 based on the measured data of pressure $P_s$, $P_d$, of temperature $T_s$, $T_d$, of differential pressure at the flow element $h_s$ or $h_d$ and on a procedure 200 here below described (and represented in FIG. 2) for the calculation of the ratio $M_w/Z_s$ between the molecular weight and the gas compressibility Z at suction conditions.

The procedure 200 comprises an initialization operation 201 of setting a first value of the ratio $M_w/Z_s$ using the value calculated in the previous execution of the procedure 200. If such value is not available because procedure 200 is being executed for the first time, the design condition values of molecular weight $M_w$ and of the gas compressibility Z at suction conditions are used. After the initialization operation 201 the iterative procedure 200 comprises a cycle 210, during which the following operations 211-220 are consecutively performed.

During the first operation 211 of the iteration cycle 210 the suction density $\gamma_s$ is calculated according to the following known-in-the-art formula:

$$\gamma_s=P_s/(R\cdot T_s)\cdot(M_w/Z_s)_{i-1} \quad \text{(B)}$$

where $(M_w/Z_s)_{i-1}$ is the value of $M_w/Z_s$ calculated at the previous iteration of the iteration cycle 210 or at initialization operation 201 is the iteration cycle 210 is being executed for the first time.

During the second operation 212 of the iteration cycle 210 the volumetric flow $Q_{vs}$ is calculated according to the following known-in-the-art formula:

$$Q_{vs}=k_{FE}\text{sqrt}(h_s\cdot 100/\gamma_s) \quad \text{(C)}$$

Where $k_{FE}$ is the flow element FE constant and "sqrt" is the square root function. If the flow element FE is positioned at the discharge side of the compressor 1 and, consequently, map 400 is used, $h_s$ is not directly measured, but can be calculated using formula A.

During the third operation 213 of the iteration cycle 210 the impeller tip speed $u_1$ is calculated according to the following known-in-the-art formula:

$$u_1=N\cdot D\cdot\pi/60 \quad \text{(D)}$$

where N is the impeller rotary speed and D is the impeller diameter.

During the fourth operation 214 of the iteration cycle 210, the flow dimensionless coefficient $\varphi_1$ is calculated according to the following known-in-the-art formula:

$$\varphi_1=4\cdot Q_{vs}/(\pi\cdot D^2\cdot u_1) \quad \text{(E)}$$

During the fifth operation 215 of the iteration cycle 210, the sound speed at suction $a_s$ is calculated according to the following known-in-the-art formula:

$$a_s=\text{sqrt}(k_v\cdot RT_s/(M_w/Z_s)_{i-1}) \quad \text{(F)}$$

where $k_v$ is the isentropic exponent.

During the sixth operation 216 of the iteration cycle 210, the Mach number $M_1$ at suction is calculated as the ratio between impeller tip speed $u_1$ and the sound speed at suction $a_s$.

During the seventh operation 217 of the iteration cycle 210, the product between the head dimensionless coefficient $\tau$ and the polytropic efficiency etap are derived by interpolation from an adimensional data array, being known $\varphi_1$ and the Mach number $M_1$.

During the eighth operation 218 of the iteration cycle 210, the polytropic head $H_{pc}$ is calculated according to the following known-in-the-art formula:

$$H_{pc}=\tau\cdot\text{etap}\cdot u_1^2 \quad \text{(G)}$$

During the ninth operation 219 of the iteration cycle 210, the polytropic exponent x is calculated according to the following known-in-the-art formula:

$$x=\ln(T_d/T_s)/\ln(P_d/P_s) \quad \text{(H)}$$

During the tenth final operation 219 of the iteration cycle 210, the value of the ratio $M_w/Z_s$ is updated according to following known-in-the-art formula:

$$(M_w/Z_s)_i=RT_s\cdot((P_d/P_s)^x-1)/(H_{pc}\cdot x) \quad \text{(I)}$$

In a second sub-step 122 of the second step 120, the calculated value of $M_w/Z_s$ is compared with an interval of acceptable values defined between a minimum and a maximum value. If the calculated value of $M_w/Z_s$ is external to such interval, an alarm is generated in a subsequent third sub-step 123 of the second step 120. The comparison check performed during the second sub-step 122 permits to validate the plurality of measurements $P_s$, $P_d$, $T_s$, $T_d$, $h_s$ or $h_d$ performed by the plurality of instruments at the suction and discharge of the centrifugal compressor 1. This can be used in particular to assist the operator, during start-up, to identify un-calibrated instruments.

If, during the first operative step 110, an instrument fault is detected the method 100 proceeds with a third step 113 of detecting if more than one instruments is in fault conditions. If the check performed during the third step 113 is negative, i.e. if only one instrument fault is detected, the method 100, for a predetermined safety time interval $t_1$, continue with a fallback step 130 of substituting the missing datum (one of $P_s$, $P_d$, $T_s$, $T_d$, $h_s$ or $h_d$) with an estimated value based on the last available value of the molecular weight and on the values of the other available measured data.

In order to identify if the safety time interval $t_1$, the method 100, before entering the fallback step 130 comprises a fourth step 114 and a fifth step 115, where, respectively, it is checked if the fallback step 130 is in progress and if the safety time interval $t_1$ is lapsed. If one of the checks performed during the fourth and the fifth steps 114, 115 are negative, i.e. if the fallback step 130 is not in progress yet or if the safety time interval $t_1$ is not lapsed yet, the fallback step 130 is performed.

If the check performed during the fourth step 114 is negative, the method 100 continues with a first sub-step 131 of the fallback step 130, where a timer is started to measure the safety time interval $t_1$. If the check performed during the fourth step 114 is positive, i.e. if the fallback step 130 is already in progress, the fifth step 115 is performed. After a negative check performed during the fifth step 115 and after the first sub-step 131, i.e. if fallback step 130 is in progress and the safety time interval $t_1$ is not expired yet, the method 100 continues with a second sub-step 132 of the fallback step 130, where the estimated value of the missing datum is determined. After the second sub-step 132, the fallback step 130 comprises a third sub-step 133 of generating an alarm in order to signal, in particular to an operator of the compressor 1, that one of the instruments is in fault condition and that the relevant fallback step 130 is being performed.

The operations which are performed during second sub-step 132 of the fallback step 130 depend on which of the instruments is in fault conditions and therefore on which measured datum is missing. In all cases, during second sub-step 132 of the fallback step 130, the last available good value of $M_w/Z_s$, i.e. calculated in the first sub-step 121 of the second step 120 immediately before the instrument fault occurred, is used.

In all cases, optionally, to further improve safety, during second sub-step 132 of the fallback step 130 the antisurge margin in the antisurge map 300, 400 is increased.

In a first embodiment of the present invention (FIGS. 3A, 3B, 4-6), the compressor 1 includes a flow element FE on the suction side and an adimensional map 300, where $h_s/P_s$ and $P_d/P_s$ are respectively mapped as abscissa and ordinate variables, is used. In normal conditions, to determine the measured operative point 301 on the map 300, the measures of the differential pressure $h_s$ from the flow element FE, and of $P_s$ and $P_d$ from the pressure sensors at suction and discharge are sufficient. In fault conditions, lack of one of the measures of $h_s$, $P_s$ or $P_d$, prevents the measured operative point 301 to be determined and requires fallback estimation to be performed. During fallback estimation values of temperature at suction and discharge $T_s$ and $T_d$ are required, as it will be evident in the following.

If, in the first embodiment of the present invention, the instrument under fault conditions is the flow element FE, differential pressure $h_s$ is estimated in the second sub-step 132 of the fallback step 130, through the following operations, performed in series:

- polytropic exponent x is calculated using formula H;
- polytropic head $H_{pc}$ is calculated from the formula I, using the last available good value of $M_w/Z_s$ and being known $T_s$, $P_d/P_s$ and x;
- product between the polytropic head dimensionless coefficient $\tau$ and the polytropic efficiency etap is calculated from formula G, being known $H_{pc}$ and $u_1$, calculated with formula D;
- sound speed $a_s$ is calculated using formula F and the last available good value of $M_w/Z_s$;
- Mach number $M_1$ is calculated as the ratio between $u_1$ and $a_s$;
- flow dimensionless coefficient $\varphi_1$ is derived by interpolation from the same adimensional data array used in the seventh operation 217 of the cycle 210, being known the product $\tau$·etap;
- volumetric flow $Q_{vs}$ is calculated from the formula E;
- suction density $\gamma_s$ is calculated according to formula B; and
- differential pressure $h_s$ is calculated from formula C, being known $Q_{vs}$, k and $\gamma_s$.

Figure 4:
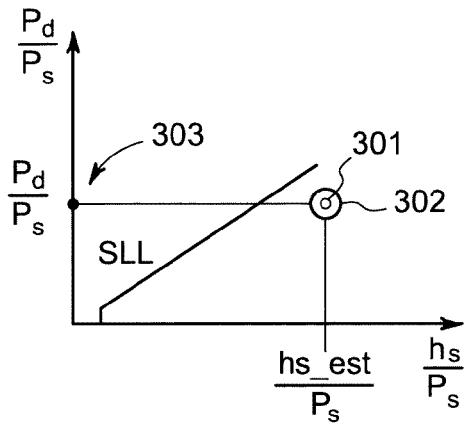
FIGS. 4, 5, and 6 are three diagrams of the antisurge map in FIG. 3B, corresponding respectively to three different failure conditions which can be managed through the method in FIG. 1, for the compressor in FIG. 3A.

With reference to FIG. 4, based on the measurements of $P_s$ and $P_d$ and on the estimation of $h_s$, the measured operative point 301 is substituted in the map 300 by the estimated operative point 302. Considering the margin of errors in the calculations and interpolation used to determine $h_s$ the estimated operative point 302 falls on a circular area including the measured operative point 301. Normally such area will be on the safety region on the right side of the SLL or at least closer to the safety region than operative points calculated in a worst-case-scenario approach. In the worst case scenario used in known methods the measured operative point 301 is substituted in the map 300 by the worst case point 303, on the ordinate axis of map 300, based on the assumption $h_s$=0. Therefore, worst case point 303 is always on the left of the SLL, causing the complete opening of the antisurge valve 307.

If, in the first embodiment of the present invention, the instrument under fault conditions is the pressure sensor at suction, suction pressure $P_s$ is estimated in the second sub-step 132 of the fallback step 130, through the following operations, performed iteratively:

- firstly, $P_s$ is defined as last available good value measured by the suction pressure sensor before fault conditions are reached;
- suction density $\gamma_s$ is calculated according to formula B, using the last available good values of $P_s$ and $M_w/Z_s$ and being known $T_s$;
- volumetric flow $Q_{vs}$ is calculated according to formula C;
- flow dimensionless coefficient $\varphi_1$ is calculated according to formula E;
- sound speed $a_s$ is calculated using formula F;
- Mach number $M_1$ is calculated as the ratio between $u_1$ and $a_s$;
- the product between the head dimensionless coefficient $\tau$ and the polytropic efficiency etap are derived by interpolation from an adimensional data array, using Mach Number $M_1$ and the above calculated value of $\varphi_1$;
- polytropic head $H_{pc}$ is calculated according to formula I;

polytropic exponent x is calculated using the following known-in-the-art formula:

$$x=R(T_d-T_s)/(M_w/Z_s)/H_{pc} \quad \text{(L)}$$

where the last available good values of $M_w/Z_s$ is used; and finally, a new value of $P_s$ is calculated from formula H, being known x, $P_d$, $T_s$ and $T_d$.

Figure 5:
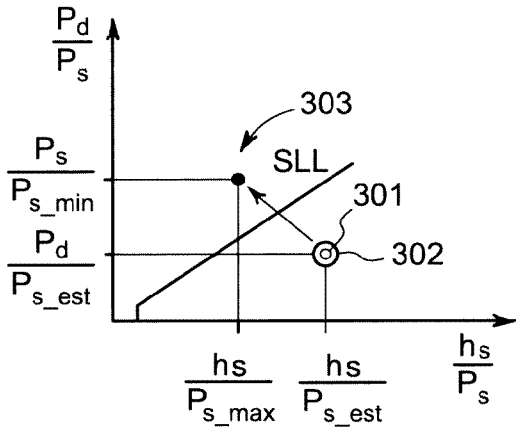

With reference to FIG. 5, based on the measurements of $h_s$ and $P_d$ and on the estimation of $P_s$, the measured operative point 301 is substituted in the map 300 by the estimated operative point 302. Considering the margin of errors in the calculations and interpolation used to determine $P_s$ the estimated operative point 302 falls on a circular area including the measured operative point 301. Normally such area will be on the safety region on the right side of the SLL or at least closer to the safety region than operative points calculated in a worst-case-scenario approach. In the worst case scenario used in known methods the measured operative point 301 is substituted in the map 300 by the worst case point 303, based on the assumptions $P_d/P_s=P_d/P_{s,min}$ and $h_s/P_s=h_s/P_{s,max}$, where $P_{s,min}$ and $P_{s,max}$ are respectively, the minimum and maximum possible value for pressure at suction. Worst case point 303 may, also in this case on the left of the SLL, cause the opening of the antisurge valve 307.

If, in the first embodiment of the present invention, the instrument under fault conditions is the pressure sensor at discharge, discharge pressure $P_d$ is estimated in the second sub-step 132 of the fallback step 130, through the following operations:

suction density $\gamma_s$ is calculated according to formula B;

volumetric flow $Q_{vs}$ is calculated according to formula C;

flow dimensionless coefficient $\varphi_1$ is calculated according to formula E;

sound speed $a_s$ is calculated according to formula F, using the last available good value of $M_w/Z_s$;

Mach number $M_1$ is calculated as the ratio between $u_1$ and $a_s$;

the product between the head dimensionless coefficient $\tau$ and the polytropic efficiency etap are derived by interpolation from an adimensional data array, using Mach number M1 and the above calculated value of $\varphi_1$;

polytropic head $H_{pc}$ is calculated from the formula G, polytropic exponent x is calculated according to formula L, using the last available good values of $M_w/Z_s$; and $P_d$ is calculated from formula H, being known x, $P_s$, $T_s$ and $T_d$.

Figure 6:
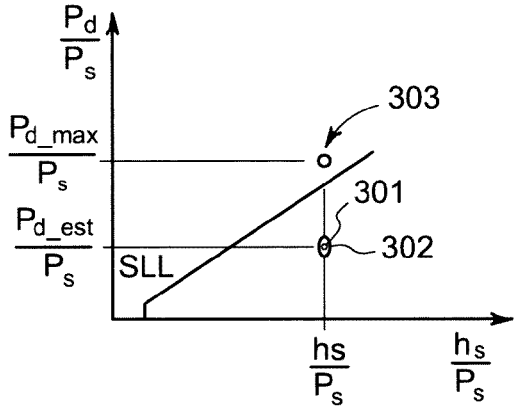

With reference to FIG. 6, based on the measurements of $h_s$ and $P_s$ and on the estimation of $P_d$, the measured operative point 301 is substituted in the map 300 by the estimated operative point 302. Considering the margin of errors in the calculations and interpolation used to determine $P_d$, which is present as a variable only on the ordinate axis of map 300, the estimated operative point 302 falls on an elongated vertical area including the measured operative point 301. Normally such area will be on the safety region on the right side of the SLL or at least closer to the safety region than operative points calculated in a worst-case-scenario approach. In the worst case scenario used in known methods the measured operative point 301 is substituted in the map 300 by the worst case point 303, based on the assumption $P_d/P_s=P_{d,max}/P_s$, where $P_{d,max}$ is the maximum possible value for pressure at discharge. Worst case point 303 may, also in this case, on the left of the SLL, cause the opening of the antisurge valve 307.

In a second embodiment of the present invention (FIGS. 7A, 7B, 8-12), the compressor 1 includes a flow element FE on the discharge side and an adimensional map 400, where $h_s/P_s$ and $P_d/P_s$ are respectively mapped as abscissa and ordinate variables, is used. Being differential pressure $h_s$ not available from measurements, the relevant value is calculated according to formula A. In normal conditions, to determine the measured operative point 401 on the map 400, the measures of differential pressure $h_d$ from the flow element FE, of $P_s$ and $P_d$ from the pressure sensors at suction and discharge and of $T_s$ and $T_d$ from the temperature sensors at suction and discharge are required. In fault conditions, lack of one of the measures of $h_d$, $P_s$, $P_d$, $T_s$ or $T_d$, prevents the measured operative point 401 to be determined and requires fallback estimation to be performed. The operations which are performed during second sub-step 132 of the fallback step 130 are similar to those described above with reference to the first embodiment of the invention and therefore and not reported in detail. Results are shown in the attached FIGS. 8-12.

With reference to FIG. 8-12, based on the estimation of the lacking datum and on the other, still available, measured data, the measured operative point 401 is substituted in the map 400 by the estimated operative point 402. Considering the margin of errors in the calculations and interpolation used to estimate the lacking datum, the estimated operative point 402 falls on a circular area (when $h_d$, $P_s$ or $P_d$ are estimated, FIGS. 8-10) or on an elongated horizontal area (when $T_s$ or $T_d$ are estimated, FIGS. 11 and 12) including the measured operative point 401. Normally such areas will be on the safety region on the right side of the SLL or at least closer to the safety region than operative points calculated in a worst-case-scenario approach. In the worst case scenario used in known methods the measured operative point 401 is substituted in the map 400 by the worst case point 403, determined by assuming that the lacking datum equals the relevant maximum or minimum possible value, whichever of the two maximum or minimum values determine, case by case, the worst conditions. Worst case point 403 may, on the left of the SLL, cause the opening of the antisurge valve 407.

According to different embodiments (not shown) of the present invention, other adimensional maps can be used, for example, if the flow element FE is positioned at the suction side of the compressor 1 a $h_r$ vs $h_s/P_s$ map. However, in all cases, the measured operative point is substituted in the adimensional map by an estimated operative point, determined through operations which are similar to those described above with reference to the first embodiment of the invention. The results are in all cases identical or similar to those graphically represented in the attached FIGS. 4-6 and 8-12, i.e. the estimated operative point on the safety region on the right side of the SLL or at least closer to the safety region than operative points calculated in a worst-case-scenario approach, preventing unnecessary intervention of the antisurge control system 309, 409 and, consequently, unnecessary opening of the antisurge valve 307, 407.

If the check performed during the third step 113 is positive, i.e. more than one instrument fault is detected, or if the check performed during the fifth step 115, i.e. only one instrument fault is detected but safety time interval $t_1$ has lapsed, the method 100 with a worst case step 140 of further substituting, in the adimensional map 300, 400, the measured operative point 301, 401 or the estimated operative point 302, 402 with the worst-case point 303, 403 based on the maximum and/or minimum values of the two or more measurements which are lacking due to the instruments faults. For example, in the first and second embodiments, the worst-case point 303, 403 are those case by case above defined and represented in the attached FIGS. 4-6 and 8-12. During the worst case step 140 an alarm is generated in order to signal, in particular to an operator of the compressor 1, that step 140 is being performed.

The execution of the worst case step 140 assures, with respect to the fallback step 130, a larger degree of safety when a second instruments is no more reliable, i.e. estimations based on the compressor behaviour model are no more possible, or when the fault on the first instrument persists for more than the safety time $t_1$, which is deemed acceptable.

This written description uses examples to disclose the invention, including the preferred embodiments, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims. Aspects from the various embodiments described, as well as other known equivalents for each such aspects, can be mixed and matched by one of ordinary skill in the art to construct additional embodiments and techniques in accordance with principles of this application

What is claimed is:

1. A method for operating a compressor, the method comprising:

acquiring a plurality of measured data obtained from a plurality of respective measuring instruments to measure a characteristic of a gas passing through the compressor at respective suction or discharge sections of the compressor;

monitoring each of the measured data from the plurality of respective instruments to detect whether any one of the plurality of measured data is missing;

in case of none of the plurality of measured data is missing, calculating a ratio of a molecular weight and a gas compressibility value of the gas based on the plurality of measured data;

in case of only one of the plurality of measured data is missing, determining an estimated value of the missing measured data, wherein the estimated value of the missing measured data is based on at least a last value of the ratio of the molecular weight and the gas compressibility value of the gas determined when none of the plurality of measured data was missing;

determining an estimated operative point on an antisurge map based on the estimated value of the missing measured data and on available measurements of the plurality of measured data; and actuating an antisurge valve according to the location of the estimated operative point on the antisurge map in comparison to a surge line (SLL).

2. The method according to claim 1, wherein the determining the estimated operative point is performed during a predetermined safety time interval.

3. The method according to claim 2, further comprising, in case of more than one of the plurality of measured data is missing and at the end of the predetermined safety time interval:

determining a worst case operative point on the antisurge map based on respective worst case values based on at least one of maximum and minimum values of the missing measurement data of the plurality of measured data; and determining a worst-case operative point on the antisurge map based on the respective worst case values and on the measured data of the other plurality of measuring instruments; and actuating the antisurge valve depending upon the location of the worst case operative point on the antisurge map in comparison to the surge line (SLL).

4. The method according to claim 1, wherein the antisurge map is an adimensional antisurge map.

5. The method according to claim 3, wherein the missing measurement data of the plurality of measured data depend on a type of the antisurge map and on a position of a flow element of the compressor.

6. The method according to claim 3, wherein the plurality of measured data is at least one of:

pressure at the suction section;

pressure at the discharge section;

pressure drop across a flow element at the suction section or the discharge section;

temperature at the suction section; and temperature at the discharge section.

7. The method according to claim 2, wherein the antisurge map is an adimensional antisurge map.

8. The method according to claim 3, wherein the antisurge map is an adimensional antisurge map.

9. The method according to claim 1, where the plurality of measured data is at least one of:

pressure at the suction section;

pressure at the discharge section;

pressure drop across a flow element at the suction section or the discharge section;

temperature at the suction section; and temperature at the discharge section.

10. A method for operating a compressor, the method comprising:

acquiring a plurality of measured data obtained from a plurality of respective measuring instruments to measure a characteristic of a gas passing through the compressor at respective suction or discharge sections of the compressor;

monitoring each of the measured data from the plurality of respective instruments to detect whether any one of the plurality of measured data is missing;

in case of none of the plurality of measured data is missing, calculating a ratio of a molecular weight and a gas compressibility value of the gas based on the plurality of measured data;

in case of only one of the plurality of measured data is missing, determining an estimated value of the missing measured data, wherein the estimated value of the missing measured data is based on at least a last value of the ratio of the molecular weight and the gas compressibility value of the gas calculated when none of the plurality of measured data was missing; and determining an estimated operative point on an antisurge map based on the estimated value of the missing measured data and on available measurements of the plurality of measured data; and wherein determining the estimated operative point on the antisurge map comprises generating an alarm to identify a failure of at least one or more of the plurality of respective measuring instruments including pressure at the suction section, pressure at the discharge section, pressure drop across a flow element at the suction section or the discharge section, temperature at the suction section, and the temperature at the discharge section used to calculate the estimated operative point of the compressor.

* * * * *